US005806189A

United States Patent [19]

Bailey

[11] Patent Number: 5,806,189

[45] Date of Patent: Sep. 15, 1998

[54] UTILITY KNIFE

[76] Inventor: Arthur Bailey, 217A Barnsboro Rd., Blackwood, N.J. 08012

[21] Appl. No.: 834,244

[22] Filed: Apr. 15, 1997

[51] Int. Cl.[6] ..... B26B 1/08

[52] U.S. Cl. ..... 30/125; 30/162; 30/330; 30/335

[58] Field of Search ..... 30/162, 335, 330, 30/329, 124, 125

[56] References Cited

U.S. PATENT DOCUMENTS

| | | | |
|---|---|---|---|
| 1,202,299 | 10/1916 | Lutz, Jr. | 30/330 |
| 1,281,664 | 10/1918 | Rosendahl | 30/330 |
| 1,355,762 | 10/1920 | Kauneckas | 30/330 |
| 1,629,412 | 5/1927 | Relich | 30/330 |
| 1,853,672 | 4/1932 | Dpdspm . | |
| 2,172,072 | 9/1939 | Rothschild | 30/125 |
| 2,736,960 | 3/1956 | Armstrong . | |
| 3,520,059 | 7/1970 | Gringer | 30/293 |
| 3,660,896 | 5/1972 | Umholtz . | |
| 4,517,741 | 5/1985 | Castelluzzo . | |
| 4,662,070 | 5/1987 | Reddig | 30/125 |
| 4,941,260 | 7/1990 | Castelluzzo | 30/162 |
| 5,036,591 | 8/1991 | Couins | 30/335 |
| 5,093,994 | 3/1992 | Karas . | |
| 5,230,152 | 7/1993 | Kennedy | 30/162 |
| 5,301,428 | 4/1994 | Wilcoz . | |
| 5,727,320 | 3/1998 | Shepherd et al. | 30/125 |

*Primary Examiner*—Hwei-Siu Payer
*Attorney, Agent, or Firm*—Thomas A. Lennox; James J. Murtha

[57] ABSTRACT

A utility knife having replaceable blades is provided having a handle with an exterior surface and an interior. A slide member is slidingly mounted in the interior of the handle. A blade is removably mounted to the slide member such that, in a first position, the blade is contained completely within the handle and, in a second position, the blade extends partially out of the handle. A shell is hinged to the handle at the exterior surface. The shell includes a central cavity shaped to receive replacement blades. Further, a utility knife having replaceable blades is provided having a handle with a first casing and a second casing. A hinge member is mounted to the first bottom edge and the second bottom edge such that the first casing can be rotated with respect to the second casing from a closed position to an open position. A slide beam is slidingly mounted on the first casing. A blade is removably attached to the front end of the slide beam. The slide beam is movable from a forward position at which the blade extends from the handle to a rearward position in which the blade is contained completely within the handle.

17 Claims, 4 Drawing Sheets

UTILITY KNIFE

BACKGROUND OF THE INVENTION

This invention is directed to the field of hand tools. In particular, the invention is related to a folding utility knife with external saddle bags for the storage of replacement blades.

Utility knives have been used in the construction field as well as other fields for numerous purposes. Typically, utility knives comprise a handle with a razor blade mounted to a sliding beam. An external button is attached to the sliding beam. As the button is depressed and pushed forward by the user's thumb, the blade extends out of the handle for use. When the button is depressed and moved rearward by the user's thumb, the blade is retracted within the handle.

Over time, the blade becomes worn and must be replaced. Utility knives typically include handles made of two separate casings. The casings are held together by a single screw. To replace the worn blade, the screw is removed and the handles are pulled apart. Replacement blades are stored within the handle. The worn blade is removed from the sliding beam and a new blade is inserted in the sliding beam. The worn blade can then be disposed of or replaced in the storage cavity in the handle until later. The casings are then fit together and the screw is replaced.

It has been found that it can be difficult on a job site to open the handle of a utility knife. In particular, the proper screw driver is required to remove the screw. Once the screw is removed, it may be difficult to handle both parts of the casing as well as the screw and the blades since there is not likely to be a convenient flat work surface, such as a table. Further, different tasks require different blades. At times, it is desirable to have a straight cutting surface. At other times, it is desirable to have a hooked cutting surface. While various blades can be carried in the storage container in the handle and replaced when needed, this can be time consuming and awkward on a particular job site.

Various knives have been developed over the years in attempts to address some of these problems. U.S. Pat. No. 5,093,994 is directed to a double-ended retractable knife. A blade carrier is slideably mounted and selectively positionable longitudinally within a housing. The carrier can be moved from a central storage position in either direction to an "in use" position at either end of the knife. The blade carrier securely positions a blade extending from each end such that one of the blades extends longitudinally from a blade opening at each end of the housing when in the "in use" position. The knife includes both a straight edged and hook edged blade for added versatility and an interior storage compartment for holding extra blades.

U.S. Pat. No. 3,660,896 is also directed to a utility knife. Two main parts form a housing. One of the parts has a side opening for receiving blades in a stack. Both parts have cooperating guide ways for receiving a button which has a free-ended pin on it for engaging a notch on a blade. means are provided that the free-ended pin is spring pressed to a position to enter the notch only in the first blade of the stack. The slider has two locking positions for the blade, one at either end of the housing. The slider also has two blade releasing positions adjacent the locking positions such that the blade may be extracted manually from either end of the housing. The slider also has a central position at which the blades can be exchanged.

U.S. Pat. Nos. 2,736,960 and 1,853,672 are directed to knives in which a blade tip can be extended from either end of the handle.

U.S. Pat. No. 5,301,428 is directed to a utility knife having a releaseably locking handle. The handle is formed from a pair of elongated mating handle halves which are connected by a central pivot. A slideable blade carrier is supported between the handle halves. The handle has a dual locking mechanism which provides for pivotal opening of the handle only when the blade carrier is in a fully forward position. A magnet which is fixed in the handle slideably supports the blade carrier.

None of these patents addresses the problems resolved by the instant invention.

SUMMARY OF INVENTION

It is, therefore, an object of an aspect of the instant invention to provide a utility knife in which the components of the knife are operably connected such that they can be readily handled in an awkward situation, such as a construction site.

It is an object of another aspect of this invention to provide a utility knife with an external storage compartment for auxiliary blades.

It is an object of another aspect of this invention to provide a utility knife in which the handle can be folded open to replace worn blades and in which replacement blades may be stored externally to the handle.

In accord with one aspect of the invention, a utility knife having replaceable blades is provided. The knife includes a handle with a first case member and a second case member. The first case member has a first bottom edge, a first front edge, a first top edge and a first rear edge. The second case member has a second bottom edge, a second front edge, a second top edge and a second rear edge. A hinge member is mounted to the first bottom edge and the second bottom edge such that the first case member can be rotated with respect to the second case member from a closed position, in which the first top edge and the second top edge are together, to an open position in which the first top edge and the second top edge are apart. In the closed position, a front slot is formed between the first front edge and the second front edge and a rear slot is formed between the first rear edge and the second rear edge. A single slide beam is slidingly mounted on the first case member. The single slide beam has a front end and a rear end. A first blade is removably attached to the front end of the single slide beam. A second blade is removably attached to the rear end of the single slide beam. The single slide beam is movable from a forward position at which the first blade is disposed in the front slot and the second blade is completely contained within the handle, a rearward position in which the second blade is disposed in the rear slot and the first blade is contained completely within the handle, and a neutral position in which the first blade and the second blade are both completely contained within the handle. A button is attached to the single slide member and extends outside the handle.

Certain implementations of this aspect of the invention provide that the first blade and the second blade have different profiles; the first blade has a straight edge and wherein the second blade has a hooked edge; a means for locking the first case member and the second case member in the closed position is provided; the locking means comprises a U-shaped clamp disposed about the first case member and the second case member; an exterior hinge is mounted to the first case member and disposed exterior to the handle, and at least one saddle bag having a blade-storage cavity with an opening is mounted to the exterior hinge and is rotatable from a closed condition in which the opening is flush against the first case member to an open condition in which the opening is distal to the first case member; a means is provided for locking the saddle bag in the closed condition; the saddle bag locking means comprises a magnet mounted to the saddle bag distal to the exterior hinge.

In accord with another aspect of the invention, a utility knife having replaceable blades is provided having a handle with an exterior surface and an interior. A slide member is slidingly mounted in the interior of the handle. A blade is removably mounted to the slide member such that, in a first position, the blade is contained completely within the handle and, in a second position, the blade extends partially out of the handle. A shell is hinged to the handle at the exterior surface. The shell includes a central cavity shaped to receive replacement blades.

Certain implementations of this aspect of the invention provide that: the handle comprises a first case member hinged to a second case member and that the shell is hinged to the first case member; the shell is a first shell and that the utility knife further comprises a second shell hinged to the second case member; the blade is a first blade and the slide member is a first slide member and that the utility knife further comprises a second slide member slidingly mounted in the interior of the handle and a second blade removably mounted to the second slide member such that, in a first position, the second blade is contained completely within the handle and, in a second position, the second blade extends partially out of the handle; the first blade has a straight edge and the second blade has a hooked edge.

In accord with another aspect of the invention, a utility knife having replaceable blades is provided having a handle with a first casing and a second casing. The first casing has a first bottom edge, a first front edge, a first top edge and a first rear edge. The second casing has a second bottom edge, a second front edge, a second top edge and a second rear edge. A hinge member is mounted to the first bottom edge and the second bottom edge such that the first casing can be rotated with respect to the second casing from a closed position, in which the first top edge and the second top edge are together, to an open position in which the first top edge and the second top edge are apart. In the closed position, a front slot is formed between the first front edge and the second front edge. A slide beam is slidingly mounted on the first casing. The slide beam has a front end and a rear end. A blade is removably attached to the front end of the slide beam. The slide beam is movable from a forward position at which the blade is disposed in the front slot and a rearward position in which the blade is contained completely within the handle. A button attached to the slide member and protruding out of the handle.

Certain implementations of this aspect of the invention provide that: an exterior hinge is mounted to the first casing and is disposed exterior to the handle and at least one saddle bag having a blade-storage cavity with an opening is mounted to the exterior hinge and rotatable from a closed condition in which the opening is flush against the first casing to an open condition in which the opening is distal to the first casing; the blade has at least one hooked edge; a means for locking the first casing and the second casing in the closed position is provided; the locking means comprises a U-shaped clamp disposed about the first casing and the second casing for locking the first casing and the second casing in the closed position; the locking means comprises a magnet mounted to the first casing distal to the hinge member for locking the handle in the closed position.

In accord with another aspect of the invention, a blade for use with a utility knife is provided. The utility knife includes a bottom edge, a top edge, a first end, and a second end. The first end includes a straight cutting surface and the second end includes a hooked cutting surface.

DESCRIPTION OF PREFERRED EMBODIMENTS

Figure 1:
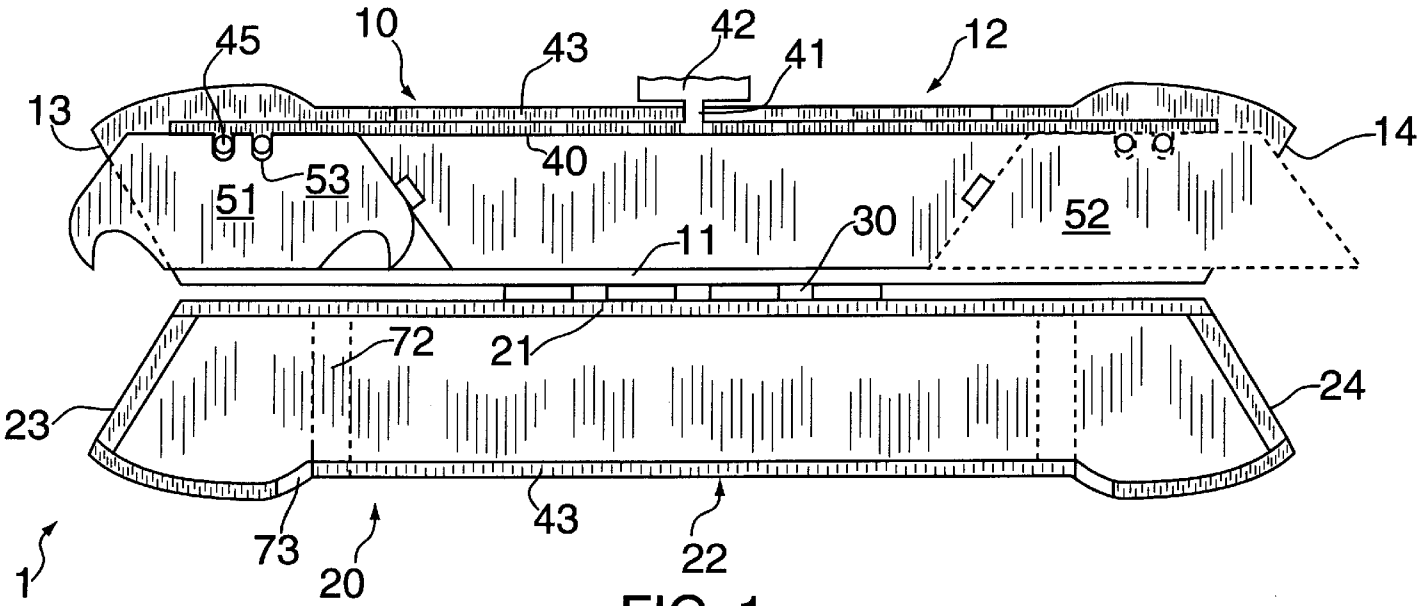
FIG. 1 is a side elevation view of a utility knife in an open position in accord with an aspect of the invention.

Referring to the drawings, one aspect of the invention is directed to a utility knife 1 having a handle 2 including a first casing or case member 10 and a second casing or case member 20. The first case member has a bottom edge 11, a top edge 12, a front edge 13 and a rear edge 14. The second case member also has a bottom edge 21, a top edge 22, a front edge 23 and a rear edge 24. A hinge 30 is mounted both bottom edges, thereby connecting the two casings. As shown, the hinge is a single, long piano hinge. However, other types of hinges may be employed and practice the invention.

Figure 2:
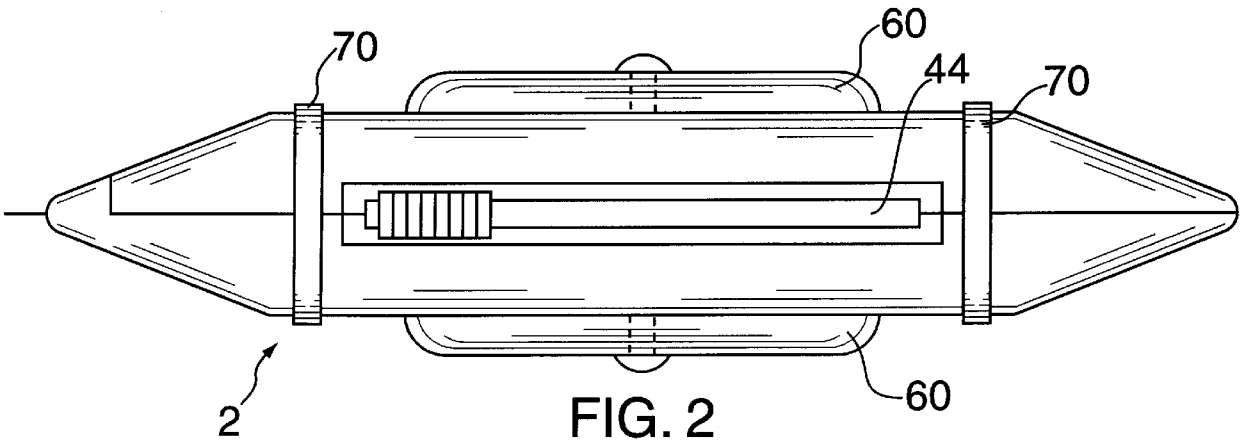
FIG. 2 is a top elevation view of the utility knife of FIG. 1.
Figure 8:
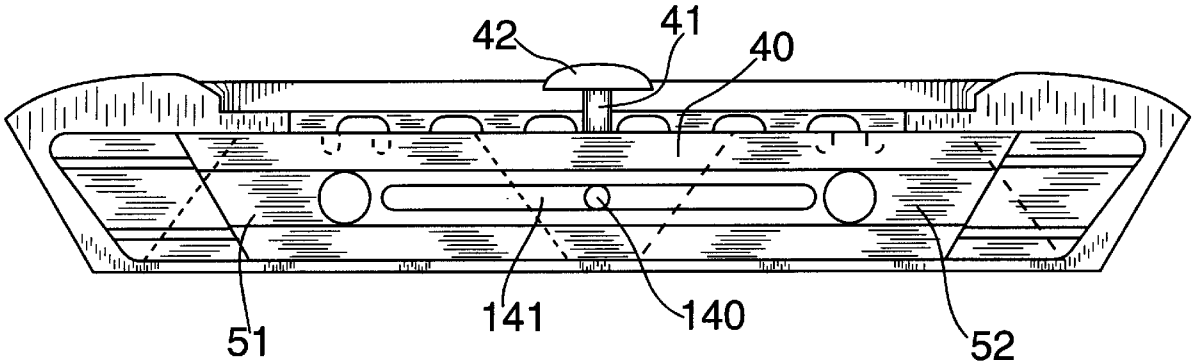
FIG. 8 is a side cut-away view a utility knife in accord with an aspect of the invention.

Referring to FIGS. 1, 2 and 8, a single slide member 40 is slidingly mounted in the first casing. A single rivet, pin or screw 140 is seated in a channel 141 in the slide member, such that the slide member can traverse side to side in the casing but will not fall out when the casings are open. A stem 41 is connected to the slide member and extends outside handle 2. A push button 42 is mounted to the stem. Indentation 43 are disposed in the top edges of the first casing 10 and the second casing 20 such that an aperture 44 is formed along the top of the handle 2 when the casings are folded to a closed position (see FIG. 2). The aperture is sized so that the stem can move from one end of the handle to the other end of the handle 2. A spring may be provided on the push button or the stem which will engage detent along the aperture, thereby locking the stem, and the slide member, in a fixed position. Various other mechanisms to lock the slide member in position may be employed as is well known in the art.

Blades 51, 52 are mounted to both ends of the slide member 40. Preferably, the blades are releaseably held in place by pegs 45 on the slide member mating with notches 53, 54 on the blades. Other means for releaseably engaging the blades to the slide member may be employed.

Figure 6:
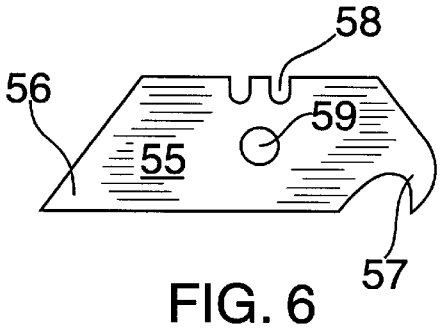
FIG. 6 is a side elevation view of a blade.
Figure 7:
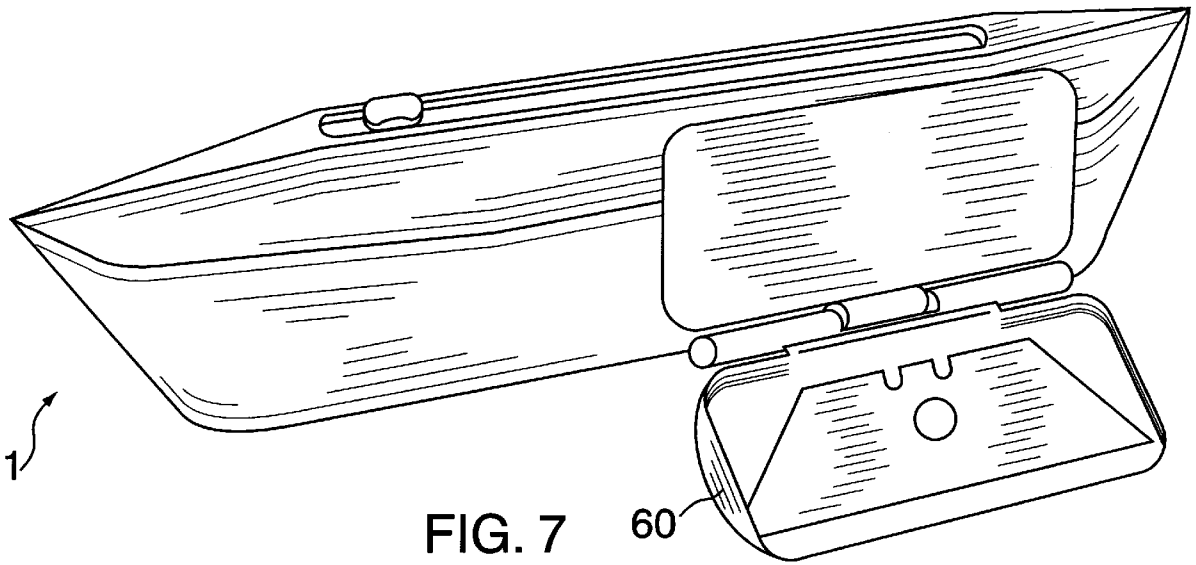
FIG. 7 is a side elevation view of a utility knife in accord with an aspect of the invention having an open saddle bag.

As currently preferred, the first blade 51 and the second blade 52 have different profiles. The first blade preferably has a hook-shaped cutting surface while the second blade has a straight cutting surface. Referring to FIG. 6, a single blade 55 may have a profile including a straight cutting surface 56 at one end and a hook-shaped cutting surface 57 at the other end. Notches 58 or a center hole 59 are be provided to permit the blade to releaseably mount to the slide member 40.

In operation, the slide member 40 can be moved from a forward position, in which the first blade 51 extends out of the handle 2 while the second blade 52 is contained completely within the handle, to a neutral position, in which both blades are contained completely in the handle (see FIG. 8), to a rearward position in which the second blade extends out of the handle while the first blade is contained completely in the handle.

Figure 5:
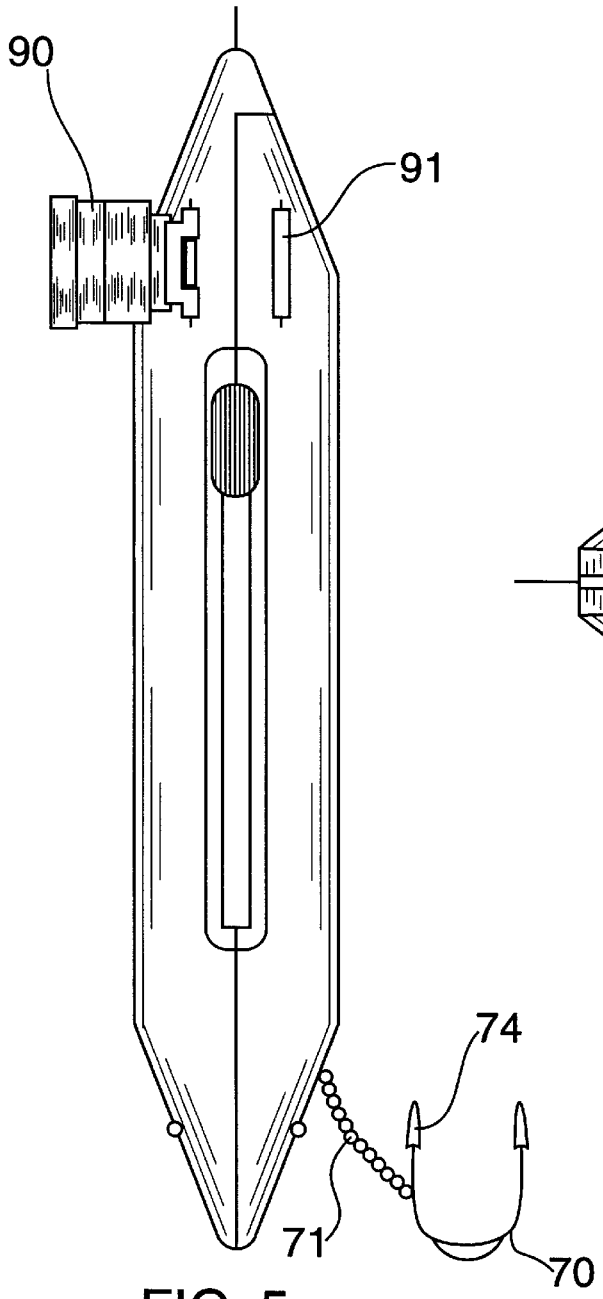
FIG. 5 is a top elevation view of a utility knife in accord with an aspect of the invention.
Figure 5A:
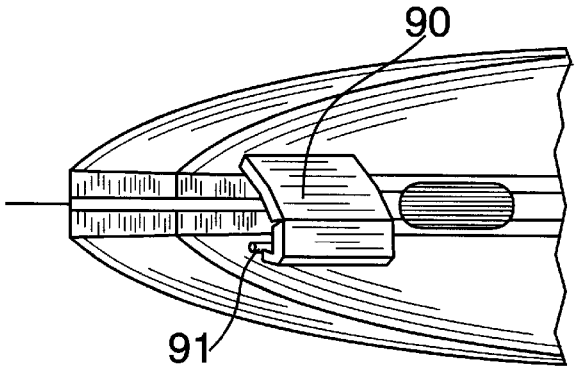
FIG. 5A is a top view in isolation of an end of the utility knife of FIG. 5.

A means for maintaining the casings 10, 20 in the closed position is provided. Preferably, a U-shaped clamp 70 is attached to one of the casings by a flexible member 71, such as a chain or a cord (see FIG. 5). When the casings are in the closed position, the U-shaped clamp can be slipped over the sides of the casing, maintaining them locked in the closed position. Grooves 72 may be provided along the exterior sides 110, 120 of the casings and flanges 74 are provided at the tip of the U-shaped clamp to hold the clamp in place.

Alternatively, a loop spring may be pivotally mounted to the bottom edge of one of the casings. When the casings are closed, the loop spring may be slipped around the front edge of the handle and positioned in the grooves. In another embodiment, a clasp 90 can be mounted to one casing. A ridge 91 is mounted to the other casing opposite the clasp. To lock the casing, the edge of the clasp in engaged to the ridge and then snapped onto the handle. To release it, the clasp is flipped off the handle. The edge of the clasp is then slipped off the ridge. It will be appreciated that a spring, a magnet, or other such mechanisms may be employed to maintain the casings in the closed position. In particular, a magnet 73 may be mounted to the top edge of one of the casings. When the casings are closed, the magnet will attract the other casing, holding them in a closed position. The magnet may be particularly useful in combination with the clamp or clasp, holding the casings closed as the clamp or clasp are applied.

Figure 3:
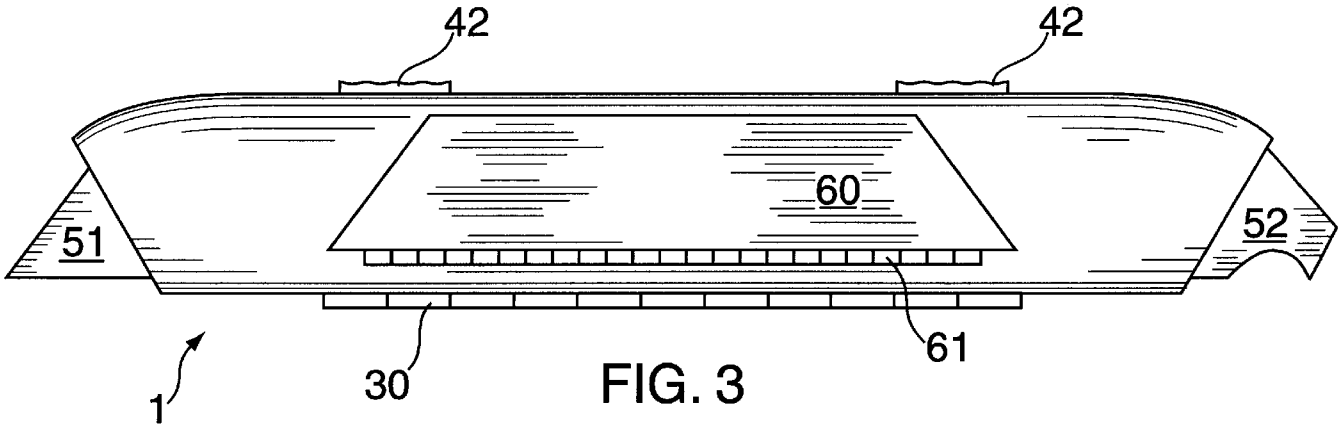
FIG. 3 is a side elevation view of a utility knife in accord with an aspect of the invention.
Figure 4:
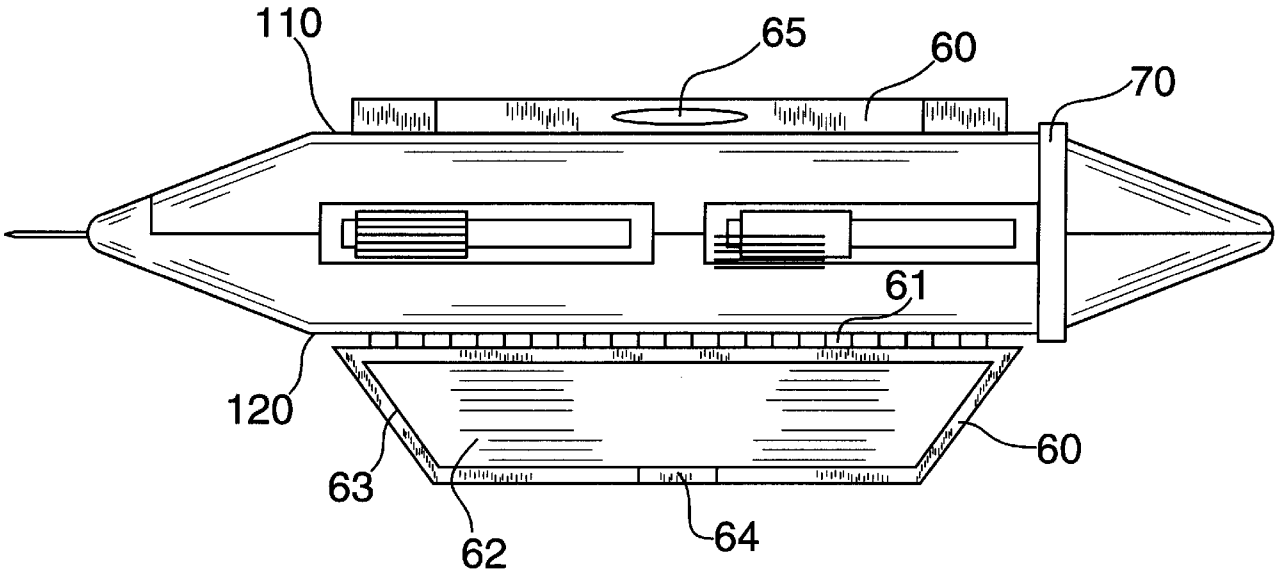
FIG. 4 is a top elevation view of the utility knife of FIG. 3.

Referring to FIGS. 3 and 4, another embodiment of the instant invention is shown. Two slide members are slidingly mounted at each end of handle 2. Distinct blades and push buttons are attached to each slide member. Each blade can be moved independently within the handle to a position extending partially out of the handle. Use of two slide members decreases the storage space available for replacement blades within the handle.

Saddle bags 60 are attached to the exterior sides 110, 120 of the casings by exterior hinges 61. Each saddle bag has a shell-shape with a central cavity 62, preferably with a profile similar to the profile of the blades 51, 52, 55. An opening 63 provides access to the cavity of the saddle bags. The saddle bag may be rotated from a closed condition in which the opening is flush against the exterior side of the handle 2 (see FIG. 3), to an open condition in which the opening 63 is distal to the side of the handle, thereby exposing the central cavity 62 (see FIG. 4). In the open condition, blades may be inserted and removed from the central cavity. Due to the shape and size of the central cavity, the blades are held in a snug fit such that they do not rattle. A foam or cloth lining or the like may be provided to prevent movement of the blades in the central cavity.

A mechanism is provided to maintain the saddle bag 60 in the closed condition. The mechanism may be a magnet 64 provided at the edge of the saddle bag distal to the exterior hinge 61. Alternatively, a spring may be provided which maintains the saddle bag in a normally closed position. A clasp, screw, hook and loop fastener or other such mechanism may also be employed and practice the invention. A finger notch 65 may be provided along the top edge of the saddle bag to allow a user to more readily grip the saddle bag and rotate it to the open condition.

To operate the utility knife 1 of the current invention, the user grips the handle 2 and presses the push-button 42 such that one or the other of the blades 51, 52 extends out between the casings 10, 20. The blade is then used in traditional fashion. When desired, the user presses the push-button and moves it to the other direction, such that the other blade extends out of the housing. When not in use, the user can displace the push-button to a neutral position such that neither blade extends out of the housing. When using the utility knife shown in FIGS. 3 and 4, each push button can be displaced independently, exposing either blade or both blades, as desired.

As the blade gets dull, the user opens the saddle bag 60 and removes a new blade. The user then closes the saddle bag and opens the casings 10, 20. The hinge 30 maintains the casings together, such that they can be easily held in one hand. The user removes the worn blade and replaces it with the new blade. The casings are then snapped closed and the casings are locked together by sliding the U-shaped clamp 70 (or clasp 90) over the side of the casings. The user opens the other saddle bag and inserts the worn blade into the central cavity. Preferably, the handle is supplied with two saddle bags: one for new blades and one for worn blades. Of course, new replacement blades can be stored in both saddle bags, if desired.

The foregoing is not a limitation on the scope of the invention which is defined by the following claims:

I claim:

1. A utility knife having replaceable blades comprising:

a handle including:

a first case member having a first bottom edge, a first front edge, a first top edge and a first rear edge;

a second case member having a second bottom edge, a second front edge, a second top edge and a second rear edge; and a hinge member mounted to the first bottom edge and the second bottom edge such that the first case member can be rotated with respect to the second case member from a closed position, in which the first top edge and the second top edge are together, to an open position in which the first top edge and the second top edge are apart, and wherein, in the closed position, a front slot is formed between the first front edge and the second front edge and a rear slot is formed between the first rear edge and the second rear edge;

a single slide beam slidingly mounted on the first case member, the single slide beam having a front end and a rear end;

a first blade removably attached to the front end of the single slide beam;

a second blade removably attached to the rear end of the single slide beam;

wherein the single slide beam is movable from a forward position at which the first blade is disposed in the front slot and the second blade is completely contained within the handle, a rearward position in which the second blade is disposed in the rear slot and the first blade is contained completely within the handle, and a neutral position in which the first blade and the second blade are both completely contained within the handle;

a button attached to the single slide member and extending outside the handle;

an exterior hinge mounted to the first case member and disposed exterior to the handle; and at least one saddle bag having a blade-storage cavity with an opening, the saddle baa being mounted to the exterior hinge and being rotatable from a closed condition in which the opening is flush against the first case member to an open condition in which the opening is distal to the first case member.

2. The utility knife of claim 1 wherein the first blade has a straight edge and wherein the second blade has a hooked edge.

3. The utility knife of claim 1 further comprising a means for locking the first case member and the second case member in the closed position.

4. The utility knife of claim 3 wherein the locking means comprises a U-shaped clamp disposed about the first case member and the second case member.

5. The utility knife of claim 3 wherein the locking means comprises a clasp mounted to the first case member and a ridge mounted to the second case member.

6. The utility knife of claim 1 further comprising a means for locking the saddle bag in the closed condition.

7. The utility knife of claim 6 wherein the saddle bag locking means comprises a magnet mounted to the saddle bag distal to the exterior hinge.

8. A utility knife having replaceable blades comprising:

a handle having an exterior surface and an interior;

a slide member slidingly mounted in the interior of the handle;

a blade removably mounted to the slide member such that, in a first position, the blade is contained completely within the handle and, in a second position, the blade extends partially out of the handle; and a shell hinged to the handle at the exterior surface which shell includes a central cavity shaped to receive replacement blades.

9. The utility knife of claim 8 wherein the handle comprises a first case member hinged to a second case member, wherein the shell is hinged to the first case member.

10. The utility knife of claim 9 wherein the shell is a first shell, the utility knife further comprising a second shell hinged to the second case member.

11. The utility knife of claim 10 wherein the blade is a first blade and the slide member is a first slide member, the utility knife further comprising a second slide member slidingly mounted in the interior of the handle and a second blade removably mounted to the second slide member such that, in a first position, the second blade is contained completely within the handle and in a second position the second blade extends partially out of the handle.

12. The utility knife of claim 11 wherein the first blade has a straight edge and the second blade has a hooked edge.

13. A utility knife having replaceable blades comprising:

a handle including:

a first casing having a first bottom edge, a first front edge, a first top edge and a first rear edge;

a second casing having a second bottom edge, a second front edge, a second top edge and a second rear edge; and a hinge member mounted to the first bottom edge and the second bottom edge such that the first casing can be rotated with respect to the second casing from a closed position, in which the first top edge and the second top edge are together, to an open position, in which the first top edge and the second top edge are apart, and wherein, in the closed position, a front slot is formed between the first front edge and the second front edge;

a slide beam slidingly mounted on the first casing, the slide beam having a front end and a rear end;

a blade removably attached to the front end of the slide beam;

wherein the slide beam is movable from a forward position at which the blade is disposed in the front slot and a rearward position in which the blade is contained completely within the handle;

a button attached to the slide member and protruding out of the handle;

an exterior hinge mounted to the first casing and disposed exterior to the handle; and at least one saddle bag having a blade-storage cavity with an opening the saddle bag being mounted to the exterior hinge and rotatable from a closed condition in which the opening is flush against the first casing to an open condition in which the opening is distal to the first casing.

14. The utility knife of claim 13 wherein the blade has at least one hooked edge.

15. The utility knife of claim 13 further comprising a means for locking the first casing and the second casing in the closed position.

16. The utility knife of claim 15 wherein the locking means comprises a U-shaped clamp disposed about the first casing and the second casing for locking the first casing and the second casing in the closed position.

17. The utility knife of claim 15 wherein the locking means comprises a magnet mounted to the first casing distal to the hinge member for locking the handle in the closed position.

* * * * *